United States Patent [19]

Miller et al.

[11] Patent Number: 4,901,494

[45] Date of Patent: Feb. 20, 1990

[54] COLLAPSIBLE FORMING SYSTEM AND METHOD

[76] Inventors: Brian J. Miller, 1619 N. Draper Rd., McHenry, Ill. 60050; David W. Turner, 318 Candlewood Trail, Cary, Ill. 60013

[21] Appl. No.: 282,054

[22] Filed: Dec. 9, 1988

[51] Int. Cl.[4] ..... E04B 2/00

[52] U.S. Cl. ..... 52/309.12; 52/426; 52/562; 249/9; 249/216

[58] Field of Search ..... 52/309.7, 309.11, 309.12, 52/404, 405, 410, 425, 426, 427, 428, 562, 563, 564, 565, 594, 712–714, 378, 379; 249/40, 41, 213–216, 219.1, 219.2, 9

[56] References Cited

U.S. PATENT DOCUMENTS

| | | | |
|---|---|---|---|
| 871,390 | 11/1907 | Dietrichs | 249/216 X |
| 1,578,511 | 3/1926 | Gladwin | 52/426 |
| 1,784,329 | 12/1930 | Bierhaalder | 249/213 X |
| 2,061,486 | 11/1936 | Schuh | 52/565 |
| 3,321,884 | 5/1967 | Klane | 52/565 |
| 4,193,573 | 3/1980 | Kinnucan, Jr. | 249/9 |
| 4,516,372 | 5/1985 | Grutsch | 52/309.12 |

FOREIGN PATENT DOCUMENTS

| | | | |
|---|---|---|---|
| 263323 | 7/1968 | Austria | 52/562 |
| 2255810 | 3/1974 | Fed. Rep. of Germany | 52/562 |
| 176868 | 3/1922 | United Kingdom | 52/426 |

*Primary Examiner*—Richard E. Chilcot, Jr.

*Attorney, Agent, or Firm*—Neuman, Williams, Anderson & Olson

[57] ABSTRACT

A collapsible forming system for hardenable material is provided which includes at least one form unit having a pair of wall panels adjustable between operative and inoperative modes. The wall panels, when in either mode, are interconnected by a grid assembly. When the wall panels are in an operative mode, they are disposed in an upright spaced relation, and when in an inoperative mode, the wall panels are disposed in a proximate face to face relation. The grid assembly includes a first section which is disposed intermediate the panels and spans the distance therebetween when the panels are in an operative mode. The grid assembly also includes a pair of second sections which are disposed adjacent exterior surfaces of said wall panels when the latter are in either mode. Each second section has a first segment engaging the adjacent wall panel exterior surface and second segments projecting laterally from the first segment and extending into corresponding holes formed in the adjacent wall panel and having portions thereof protruding from the wall panel interior surface. The protruding portions are interlockingly engaged by portions of the grid assembly first section. The interlocking portions form pivotal connections having one upright axis adjacent the interior surface of one wall panel and a second upright axis adjacent the interior surface of the second wall panel of the pair.

16 Claims, 2 Drawing Sheets

FIG. 9
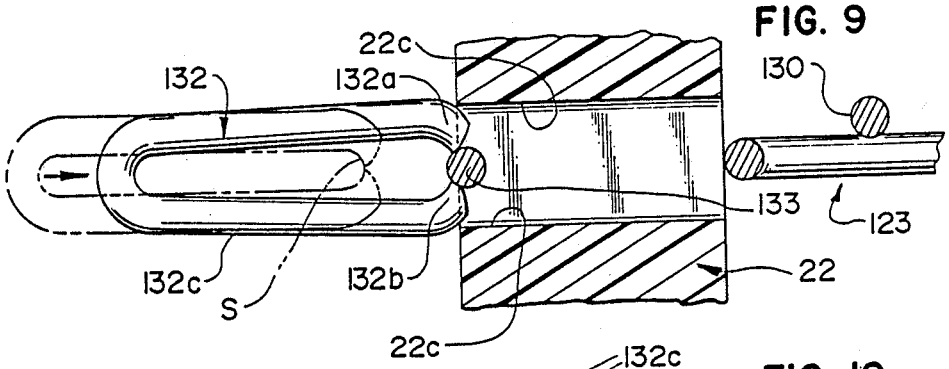
FIG. 6
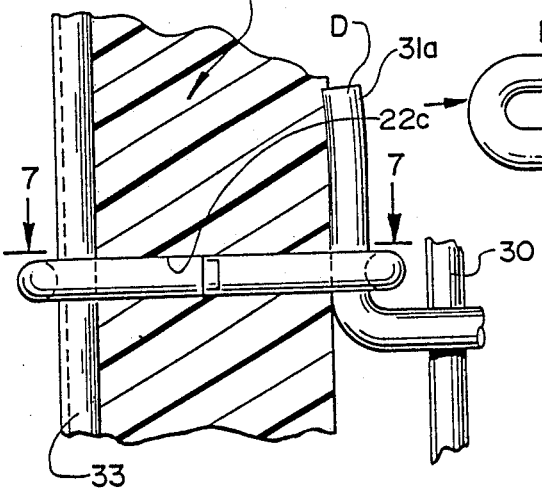
FIG. 10
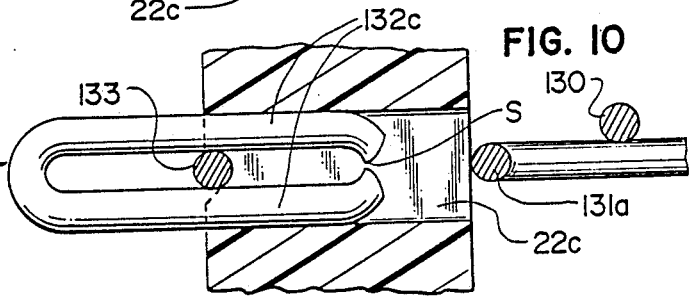
FIG. 11
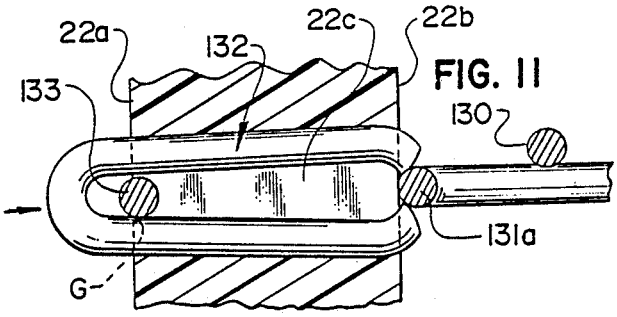
FIG. 7
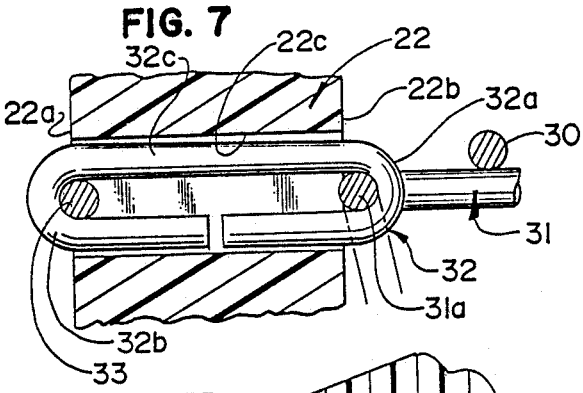
FIG. 12
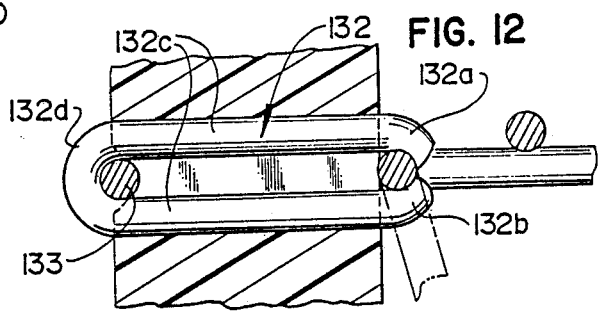
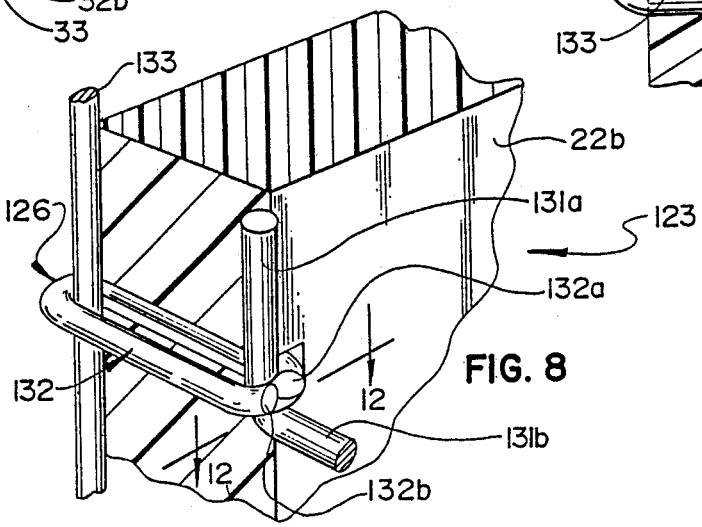
FIG. 8

COLLAPSIBLE FORMING SYSTEM AND METHOD

BACKGROUND OF THE INVENTION

Various forming systems for a hardenable material, such as concrete, and methods have heretofore been utilized when constructing foundation walls and the like. Such prior forming systems and methods, however, are beset with one or more of the following shortcomings: (a) the forming system is constructed at the site and requires an inordinate amount of manual labor, (b) the method of construction is awkward and time-consuming; (c) the forming system must be disassembled and removed from the site when the wall material has reached a hardened state; (d) if the form units comprising the system are factory assembled they cannot assume a collapsed state when being shipped to the construction site; (e) the various components comprising the system are of costly, bulky, and heavy construction; and (f) special procedures and materials must be utilized after the wall panels have been removed in order to provide adequate thermal insulation and a moisture barrier for the formed wall.

SUMMARY OF THE INVENTION

An improved forming system and method are provided which effectively avoid all of the aforenoted shortcomings.

The improved forming system is of simple, inexpensive, yet durable construction and requires a minimum amount of manual labor to set up.

The improved forming system and method does not require the services of numerous carpenters or skilled laborers in order to set up the forming system.

The improved forming system incorporates a skeletal grid assembly which allows the aggregate entrained in the poured concrete to readily flow past the grid components when the concrete is being poured thereby resulting in the wall having uniform density throughout.

The improved forming system may readily assume a collapsed mode when being stored or shipped to the construction site, thus occupying a significantly smaller amount of space.

The improved system may be quickly and easily installed with a minimum amount of manual effort.

Further and additional advantages inherent in the improved forming system and method will become apparent from the description, accompanying drawings and appended claims.

In accordance with one embodiment of the invention a collapsible forming system for hardenable material is provided which includes a pair of wall panels and a grid assembly which interconnects the wall panels and allows them to assume either an operative or inoperative mode. When in the operative mode, the wall panels assume a predetermined spaced, substantially parallel relation and, when in an inoperative mode, assume a collapsed, face to face proximate relation. The grid assembly includes a first section which is disposed intermediate the wall panels at all times and spans and maintains the distance therebetween when the wall panels are in the operative mode. The grid assembly also includes a pair of second sections which are disposed adjacent the exterior surfaces of the wall panels. Each second section is hingedly connected to an adjacent segment of the first section and coacts therewith to secure the adjacent wall panel between said first section and the second section when the wall panels are in either mode.

DESCRIPTION OF THE DRAWINGS

For a more complete understanding of the invention reference should be made to the drawings wherein:

FIG. 6 is an enlarged fragmentary sectional view taken along line 6—6 of FIG. 1.

FIG. 7 is a sectional view taken along line 7—7 of FIG. 6.

FIG. 8 is a fragmentary, perspective view in vertical section showing a second embodiment of the improved collapsible forming system with the wall panels thereof in an operative mode.

FIGS. 9–11 are fragmentary enlarged views of the system of FIG. 8 taken in horizontal section and showing the grid assembly components in various stages of assembled relation.

FIG. 12 is a sectional view taken along line 12—12 of FIG. 8.

Figure 1:
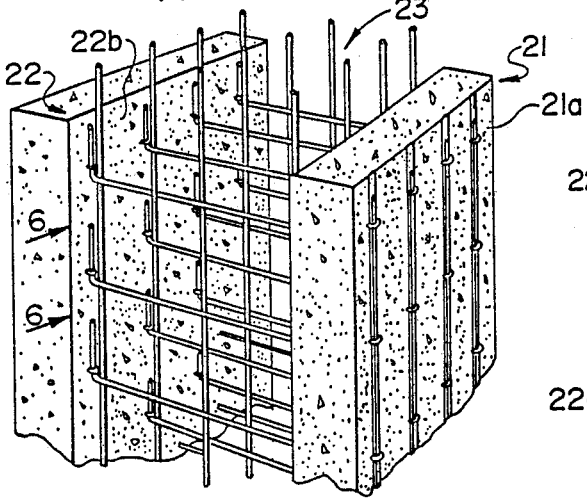
FIGS. 1 and 2 are fragmentary perspective views of one embodiment of the improved system showing the wall panels thereof in an operative mode and located at a predetermined construction site.
Figure 3:
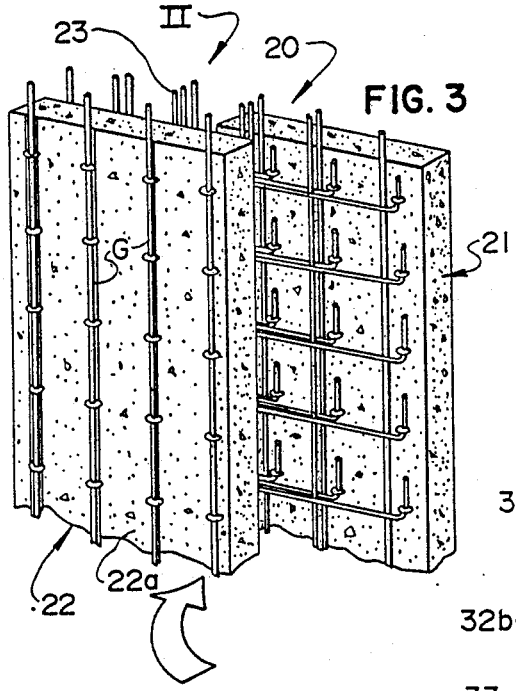
FIG. 3 is a fragmentary perspective view similar to FIG. 2 but showing the wall panels thereof in an inoperative mode.
Figure 4:
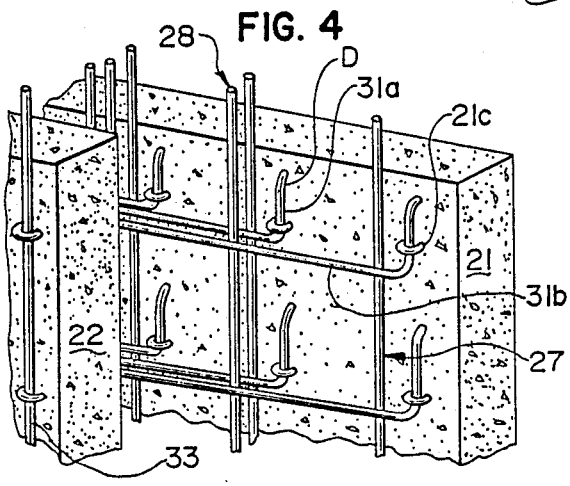
FIG. 4 is similar to FIG. 3 but on an enlarged scale.

Referring now to the drawings and more particularly to FIGS. 1 and 3, an improved collapsible forming system 20 is shown for forming foundation walls and the like of hardenable material such as concrete. The system 20, as shown, includes a pair of wall panels 21, 22 which are interconnected by a grid assembly 23. The grid assembly allows the wall panels to assume either an operative mode I, FIG. 1 or a collapsed inoperative mode II, FIG. 3.

The wall panels 21, 22 are normally $4' \times 8'$ sheets of foam plastic material (,e.g. EPS, styrofoam or other plastic material having similar characteristics,) or in some installations the panels may be formed of corrugated fibreboard material where a thermal barrier is not a critical consideration. Where the wall panels are of a foam plastic material (EPS) it is preferred to have a two inch thickness with a two pound density and a capability of withstanding compressive forces of approximately twenty five pounds per square inch (25 psi) before there is a permanent set imposed on the material.

Where corrugated fibreboard is used as the wall panel material it may be a $\frac{3}{8}''$ double-wall construction.

Figure 2:
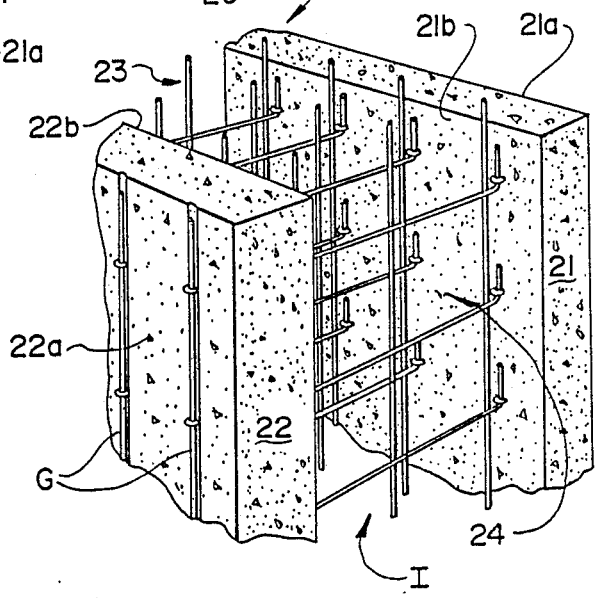

When the wall panels 21, 22 assume the operative mode I, see FIGS. 1 and 2, the panels are disposed in a spaced, substantially parallel relation. The spacing 24 between the panels, when in the operative mode may vary from about 6" to about 10" and will depend upon the thickness of the wall desired. As aforementioned the wall panels 21 and 22 are preferably formed of foam-plastic or an equivalent material having the desirable characteristics, such as low cost; lightweight, capable of withstanding substantial compression forces (e.g. 25 psi"); easy to cut and physically handle and far superior thermal insulative capabilities.

Figure 5:
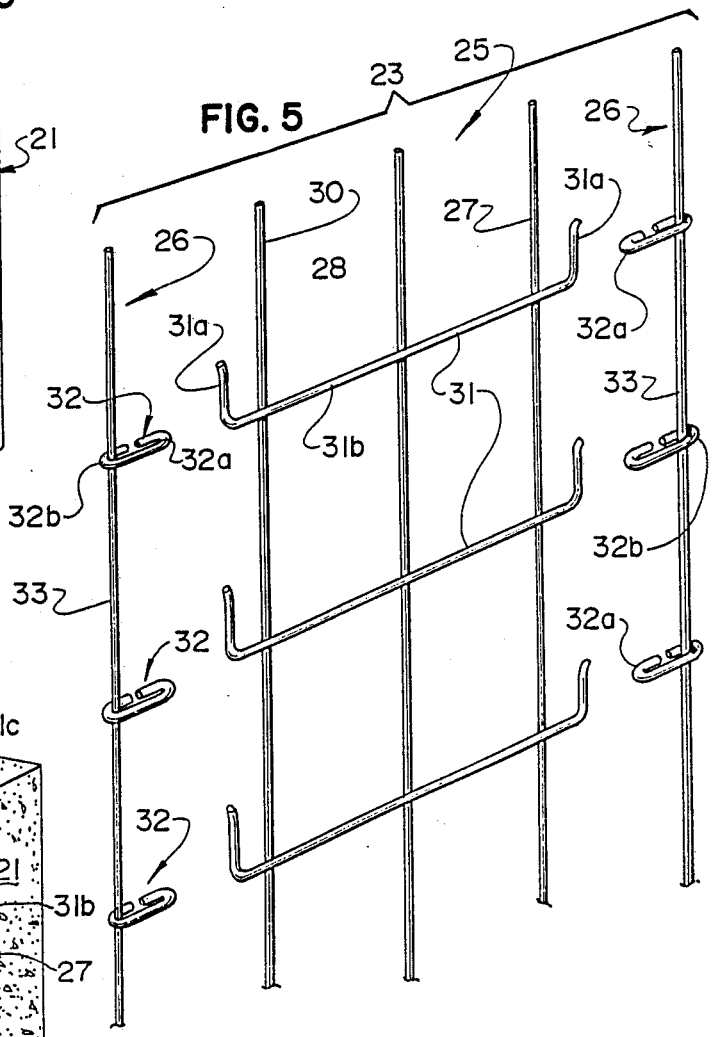
FIG. 5 is a fragmentary perspective view of a grid assembly of FIG. 1 but showing the first and second sections thereof in an exploded relation.

The grid assembly 23 includes a skeletal first section 25, see FIG. 5, which is disposed within the spacing 24 formed between the wall panels 21 and 22. A plurality of grid assemblies 23 are utilized in the forming system and the first sections 25 thereof are arranged in parallel relation and are preferably spaced apart 4", when the wall panels are in operative mode I. Second sections 26 also form part of each grid assembly 23 and are disposed in opposed relation and engage the exterior surfaces 21*a* and 22*a* of the wall panels as will be described more fully hereinafter. Both the first and second sections 25 and 26 include a plurality of rodlike components preferably formed of ten-gauge steel wire.

Each first section includes a plurality of vertically extending rod members 27, 28 and 30 which are arranged in spaced parallel relation. Members 27 and 30 are disposed adjacent the opposed interior surfaces 21*b* and 22*b* of the wall panels and member 28 is disposed between and substantially equidistant from members 27 and 30, see FIG. 5. The number of vertically extending members may vary and will depend upon the spacing between the wall panels. The vertically disposed rod members 27, 28 and 30 are retained in their predetermined upright positions by a plurality of horizontally extending, vertically spaced cross rod members 31. The members 31 are preferably on 4" centers, but may be spaced apart a greater or lesser amount, if desired. The cross rod members 31 are secured to the upright rod members 27, 28 and 30 by spot welding or some other suitable means. The opposite ends 31*a* of each cross rod member are offset upwardly, or downwardly, and interlock with an adjacent looped end 32*a* of a link piece 32, the latter forming a part of a second section 26 of the grid assembly 23, as will be hereinafter described.

Each second section 26 is of like configuration and includes a vertical rod member 33 which is adapted to engage the exterior surface 21*a*, 22*a* of the adjacent wall panel 21, 22. Each exterior surface is preferably provided with a plurality of vertically extending spaced parallel grooves G, each of which is sized to accommodate a rod member 33. As seen in FIG. 5, each rod member 33 is connected by spot welding or the like to the opposite or outer looped end 32*b*. of each vertically spaced link piece 32. The spacing between the link pieces will correspond to the spacing between the cross rod members 31 of the first section 25. The link pieces 32 are of like configuration and extend at right angles to rod member 33 and project through suitable holes 21*c*, 22*c* which are formed in each wall panel and extend from the exterior surface to the interior surface thereof, see FIGS. 6 and 7. The looped ends 32*a*, 32*b* of each link piece 32 are interconnected by an elongate central portion 32*c* which is disposed within the adjacent panel hole. The overall length of each link piece is such that rod member 33 when disposed within the exterior panel groove G will extend through loop end 32*b* and the offset end 31*a* of the cross rod 31 will extend through loop end 32*a*. The interconnection between offset end 31*a* and looped end 32*a* is pivotal thereby allowing the cross rod member 31 to rotate through a sector of approximately 90° when the wall panels assume the collapsed inoperative mode II. The relative position of each of the cross rod members 31 when the panels are in mode II is shown in phantom lines in FIG. 7. To prevent the system from accidentally assuming a collapsed mode II while the system is being installed at the construction site, the distal ends D of the offset ends 31*a* of each cross rod member 31 may be curved outwardly a small amount or the included angle between the offset end 31*a* and the center portion 31*b* of the cross rod member may be greater than 90° (e.g. 92°). Thus, when the panels assume mode I, the distal ends D of the rod members 31 will penetrate, or bite into, the interior surface 21*b*, 22*b* of the adjacent panel and the latter will frictionally resist further pivoting movement.

A modified embodiment of the grid assembly 123 is shown in FIGS. 8–12 wherein in place of the link piece 132 being affixed to the upstanding rod member 133 of the second section 126 it is in the form of a separate spring clip. The clip 132 is preferably formed of a suitable spring steel and has an elongated U-configuration with the free ends 132*a* and 132*b* of the leg portions 132*c* thereof in spaced relation and curved inwardly towards one another. When the clip (link piece) 132 is interconnecting the exterior rod member 133 with the adjacent offset end portion 131*a* of the cross rod member 131, the curved free ends 132*a* and 132*b* of the clip 132 embrace the rod member offset end portion 131*a* and the bail portion 132*d* of the clip interconnecting the opposite ends of the leg portions 132*c* embraces the rod member 133, see FIGS. 8 and 12.

In manipulating the clip 132 into interconnecting relation with the rod members 133 and 131, the clip (phantom lines, FIG. 9) is initially positioned adjacent the exterior surface of the wall panel and in alignment with a hole 22*c* or 21*c* formed in the adjacent wall panel 22 or 21 so that the rod member 133 is substantially centered in the spacing S between the curved ends 132*a*, 132*b*, see FIG. 9. The clip 132 is then pushed against rod member 133 whereby the latter wedges between the ends 132*a*, 132*b* forcing the leg portions to be cammed apart sufficiently to allow the rod member 133 to pass therebetween. The clip ends 132*a*, 132*b* may be rounded or beveled so as to facilitate the camming effect by the rod member 133. The wall panel material is resiliently compressible so as to allow the clip leg portions 132*c* to spread apart without the exterior end of the hole 22*c* being permanently distorted. As soon as the curved clip ends 132*a*, 132*b* have moved past the rod member 133, the leg portions 132*c* automatically resume their normal parallel positions, see FIG. 10. The panel hole 22*c* is sized to readily allow the clip to move endwise therethrough when the leg portions are in their normal parallel position. The spacing between the parallel leg portions is slightly greater than the diameter of the rod member 133 so that the clip can be readily pushed endwise until the curved ends 132*a*, 132*b* engage the offset end 131*a* of the cross rod member 131. Further inward pushing of the clip 132 will cause the curved ends 132*a*, 132*b* of the leg portions 132*c* to once again be cammed apart by the offset end 131*a*, see FIG. 11, so as to allow the latter to pass therebetween. Once the offset end has moved past the clip curved ends, the clip will automatically snap back to its original configuration causing the offset end 131*a* of the cross rod member 131 of the grid assembly 123 to be snugly embraced by the clip curved ends, see FIG. 12. The interior end of the wall panel hole 22*c* will readily distort without taking a permanent set to enable the clip end portions to be cammed apart a sufficient amount to allow the offset end portion 131*a* to pass therebetween, see FIG. 11.

In lieu of the wall panels being provided with preformed holes 22*c*, the leading end of the clip 132, formed by the curved ends 132*a*, 132*b*, may be heated to a predetermined temperature whereby the wall panel material in the vicinity of the clip leading end will melt as the clip leading end penetrates the wall panel thereby forming the required hole. As in the case of grid assembly 23, the interconnection between the offset end 131*a* of member 131 and the embracing curved ends 132*a*, 132*b* allows the cross rod member 131 to pivot through an arc of approximately 90°, when the wall panels 21, 22 are moved between the operative and inoperative modes.

As aforementioned, the grid assemblies 23, 123 are normally spaced apart 4" and the wire utilized to make the components of the grid assembly has a diameter of approximately ⅛" and thus, the first sections do not seriously impede the flow of the hardenable material, even though it includes entrained aggregate, when the material is being poured between the wall panels. Thus the formed wall has uniform density. Once the poured material hardens the wall panels may remain in place. If the wall panels are of foam plastic they will provide effective thermal insulation and allow the hardenable material to be poured and hardened even in freezing weather.

With either forming systems, the wall panels thereof assume a collapsed inoperative mode while the system is being transported to the construction site. Once at the construction site, the wall panels are erected and manually adjusted to the operative mode and set in place at a predetermined location within the construction site. The hardenable material, while in a flowable state, is then poured between the spaced wall panels whereby a section of the grid assembly becomes embedded in the hardenable material. The poured material is then allowed to harden between the wall panels. The wall panels remain in place after the material has hardened. Before there is back-filling of the wall, a moisture barrier material may be applied to one, or both, of the exterior surfaces of the wall panels.

Thus, a collapsible forming system and method have been provided wherein the system is strong, yet lightweight; easy to install; requires a minimum amount of manual effort; may be readily transported to a construction site while in a collapsed mode and does not require the removal of the system components once the wall is formed.

We claim:

1. A collapsible preassembled forming system for a hardenable material comprising a pair of wall panels of lightweight substantially inflexible material, said wall panels being adjustable between an operative mode wherein said panels are in a predetermined spaced relation for accommodating the hardenable material therebetween and a collapsed inoperative mode wherein said panels are in an offset at least partially face to face proximate relation for transporting said wall panels while in the collapsed mode to a job site; and grid means pivotally interconnecting said panels, said grid means including a plurality of relatively spaced grid assemblies, each having a skeletal first section disposed intermediate said panels and defining a plane substantially perpendicular to said panels when the latter are in said operative mode and substantially parallel to interior surfaces of said panels when the latter are in an inoperative mode, said skeletal first section having a plurality of elongate first rods substantially spanning the distance between said panels when in the operative mode, and a plurality of elongate second rods affixed to said first rods and retaining the latter in a predetermined spaced relation, and a plurality of second sections, each having a first portion engaging an exterior surface of one wall panel and a plurality of relatively spaced second portions extending angularly from said first portion through said one wall panel and each having an end terminating adjacent an interior surface of said one wall panel, said terminating end and an adjacent end of a predetermined first rod coacting to form a pivotal connection between the skeletal first section and the said one wall panel, said grid means permanently affixing said wall panels to exterior surfaces of the hardenable material accommodated between said wall panels when in a hardened state.

2. The system of claim 1 wherein said wall panels have interior and exterior surfaces; when said panels are in the operative mode, the panel interior surfaces are spaced apart from about 6" to about 10".

3. The system of claim 1 wherein the grid assemblies are spaced apart about 4" when the wall panels are in the operative mode.

4. The system of claim 1 wherein the wall panels are of thermal insulative material.

5. The system of claim 1 wherein the first and second sections of each grid assembly are formed of steel wire.

6. The system of claim 5 wherein each first rod extends substantially horizontally and each second rod extends substantially vertically when said wall panels are in the operative mode.

7. The system of claim 1 wherein each second section first portion is a vertically extending rod member and at least one second section second portion is a link means, the latter having loops formed at opposite ends thereof, one loop accommodating the second section rod member, a second loop of said second portion coacting with a first rod of the first section to form the pivotal connection.

8. The system of claim 7 wherein the link means one end of each second section is fixedly connected to the vertically extending rod member of said second section.

9. The system of claim 7 wherein the link means of each second section includes a spring clip.

10. The system of claim 9 wherein the spring clip has an elongate substantially U-configuration with spaced free end portions curved inwardly towards one another to form a loop.

11. The system of claim 10 wherein the spring clip includes loop-forming bail portion opposite the spaced free end portions; said bail portion being adjacent the wall panel exterior surface and in embracing relation with the vertically extending rod member of a grid assembly second section first portion.

12. The system of claim 11 wherein the curved free end portions of the spring clip are disposed adjacent the interior surface of the wall panel and are in embracing loop forming relation with a portion of the grid assembly first section.

13. The system of claim 7 wherein the link means extends through a ;hole formed in the adjacent wall panel, said hole extends between the interior and exterior surfaces of the adjacent wall panel.

14. The system of claim 13 wherein the wall panel hole is preformed.

15. The system of claim 7 wherein the vertically extending rod member of each second section is located within a vertically extending groove formed in the exterior surface of the adjacent wall panel.

16. The system of claim 1 wherein at least one end of a first rod of a skeletal first section frictionally engages an interior surface of a wall panel when said wall panels are in the operative mode.

* * * * *

UNITED STATES PATENT AND TRADEMARK OFFICE

CERTIFICATE OF CORRECTION

PATENT NO. : 4,901,494

DATED : February 20, 1990

INVENTOR(S) : Brian J. Miller et al

It is certified that error appears in the above-identified patent and that said Letters Patent is hereby corrected as shown below:

Column 6, line 44, "a" should be inserted after "includes".

line 52, a hyphen should be inserted between "loop" and "forming".

line 55, delete ";".

Signed and Sealed this

Thirtieth Day of April, 1991

*Attest:*

HARRY F. MANBECK, JR.

*Attesting Officer*

*Commissioner of Patents and Trademarks*